United States Patent [19]

Mueller et al.

[11] Patent Number: 4,568,006

[45] Date of Patent: Feb. 4, 1986

[54] NESTABLE SELF-VENTING SPOUT

[75] Inventors: Hugo Mueller, Livingston; Davis B. Dwinell, Warren Township, Somerset County; Jeremiah J. Laurizio, New Providence, all of N.J.

[73] Assignee: American Flange & Manufacturing Co. Inc., Linden, N.J.

[21] Appl. No.: 667,409

[22] Filed: Nov. 5, 1984

Related U.S. Application Data

[63] Continuation of Ser. No. 373,023, Apr. 29, 1982, abandoned.

[51] Int. Cl.[4] ..... B67D 3/00

[52] U.S. Cl. ..... 222/488; 222/478; 222/530; 222/541; 222/567

[58] Field of Search ..... 222/481.5, 571

[56] References Cited

U.S. PATENT DOCUMENTS

| | | | |
|---|---|---|---|
| 1,829,003 | 10/1931 | Harps | 222/564 |
| 2,695,736 | 11/1954 | Punte | 222/489 |
| 3,330,450 | 7/1967 | Clare | 222/479 |
| 4,236,629 | 12/1980 | Dwinell | 222/529 |
| 4,294,382 | 10/1981 | Summers et al. | 222/529 |
| 4,295,583 | 10/1981 | Schurr | 222/478 |
| 4,320,861 | 3/1982 | Rieke et al. | 222/541 |

FOREIGN PATENT DOCUMENTS

| | | | |
|---|---|---|---|
| 473716 | 7/1969 | Switzerland | 222/478 |
| 16791 | of 1892 | United Kingdom | 222/481.5 |

*Primary Examiner*—Joseph J. Rolla
*Assistant Examiner*—Michael S. Huppert

[57] ABSTRACT

A nestable spout assembly for dispensing liquid products from cans and pails. A molded plastic spout in extended position has an enlarged flexible lower wall portion joined to a relatively rigid externally threaded upper wall portion. A peripheral sealing channel is disposed about the base of the lower wall portion for securing to a container wall opening neck by means of an overlying metal crimping ring. A tear out diaphragm is recessed within the spout upper wall portion above the spout thread and provided with an integrally molded ring pull for removal. A circumferentially enlarged plastic reclosing cap threadedly engages the spout upper wall portion and also interlockingly engages the metal crimping ring with the spout in nested position to close off the annular spout void against contamination. A separate generally cup shaped pouring vent is included in the spout assembly to facilitate smooth, surge free, pouring. The vent has a generally cylindrical outer baffle wall, an annular bottom wall and a generally cylindrical inner liquid passageway. A series of air entry apertures are formed in the upper portion of the outer baffle wall which terminates at its uppermost end in a circumferential lip adapted for seating within the spout sealing channel.

14 Claims, 5 Drawing Figures

FIG. 3
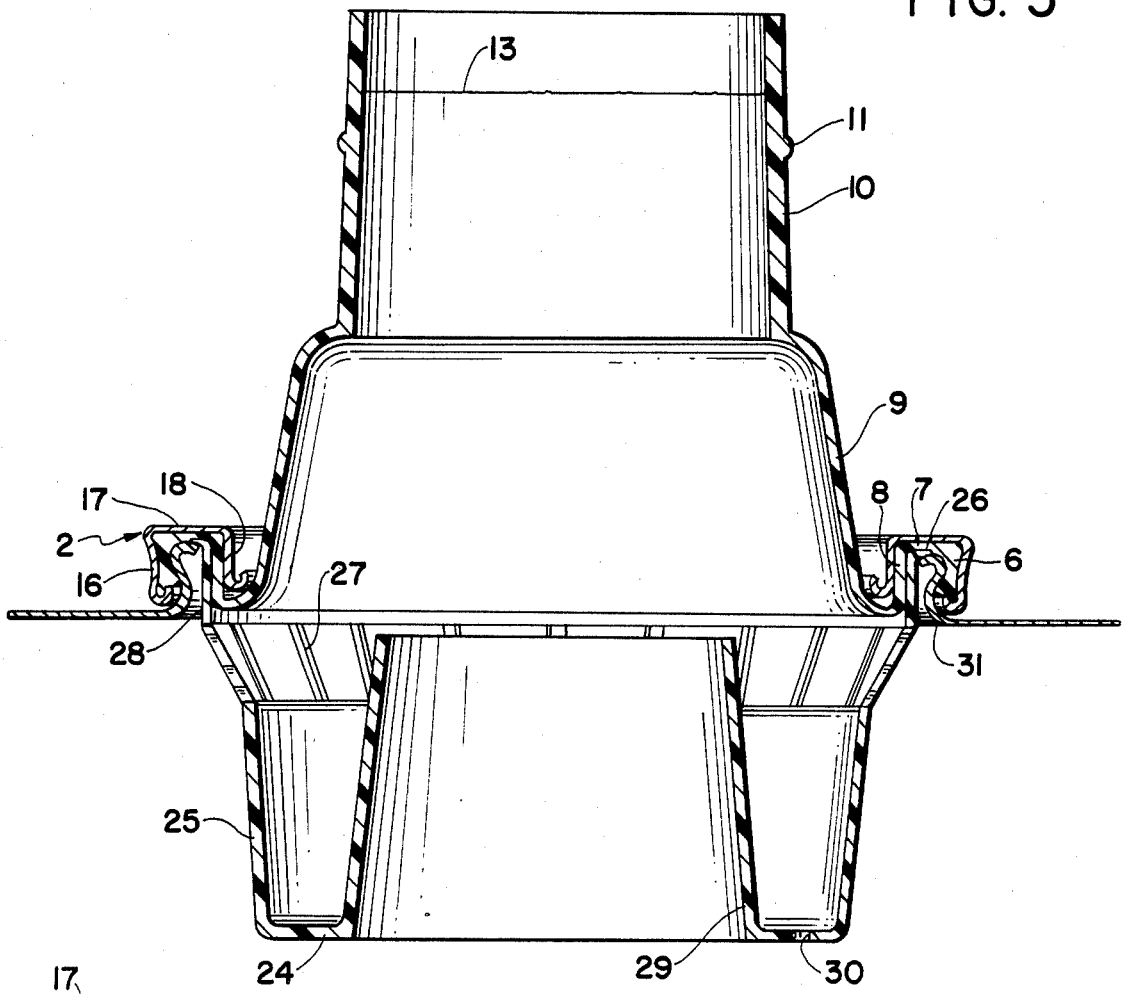
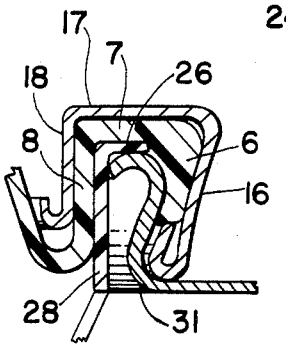
FIG. 3a
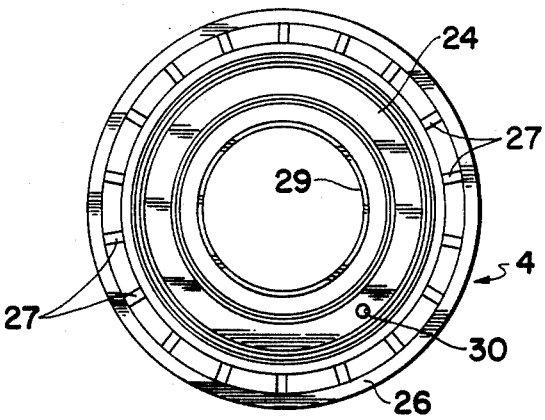
FIG. 4

NESTABLE SELF-VENTING SPOUT

This is a continuation of application Ser. No. 373,023 filed Apr. 29, 1982, now abandoned.

BACKGROUND OF THE INVENTION

The incorporation of a self venting device in liquid dispensing spouts has long been recognized as a desirable aid in providing smooth, surge free pouring. One type of pouring spout commonly used on industrial size pails and cans consists of a collapsible spout having a flexible wall portion which allows the spout to be raised from a compact stored or nested condition to a fully extended pouring position. These prior art pouring spouts are available incorporating a self vent device which eliminates the need for a completely separate and more costly vent in the head of the container. In general terms such vent devices consist of an elongated tubular member having a circumferentially outwardly disposed flange at its lower end. With the spout in nested or stored position the upper portion of the tubular vent is affixed to the spout interior with the major portion of the vent extending axially beyond the spout into the container. Upon raising the flexible spout to extended pouring position the vent member is also axially displaced bringing the vent flange closely adjacent the spout base and providing a series of air entry passages therebetween.

The above described prior art constructions while adequately performing their intended venting functions possess certain structural deficiencies which this invention overcomes. Of principal concern, the rather considerable overall axial elongation of the collapsed or nested closure as results from incorporation of the prior art tubular vent constructions has serious drawbacks. For example, it is common practice for the pail manufacturer to furnish heads complete with closure independently of pail bodies which bodies are stacked nested within each other to reduce shipping costs. It is also the practice to stack pail covers, however, that is virtually impossible with a pouring vent which doubles the vertical profile of the closure. In fact, even shipment of the closures per se becomes more costly as a result of the substantially increased bulk due to the prior art self vent. A further drawback resides in the necessity of securely affixing the vent member within the spout interior during manufacture. This fabrication is normally performed as a heat sealing operation which is not only costly but must be consistently strong enough to prevent separation during shipment and handling. Also, once the vented closure is applied to a filled pail the tendency of the vent to separate from the spout becomes even greater due to the mechanical sloshing action of the fluid. Chemical attack alone by the packaged fluid may severely stress the heat sealed joint between the spout and vent.

SUMMARY OF THE INVENTION

The invention is directed to a flexible pouring spout assembly for dispensing liquid products from containers.

The drawbacks inherent in the above mentioned and other prior art self vented spouts are eliminated by the construction of the invention in providing an improved flexible wall pouring spout closure of the type moveable by reversing the configuration of the flexible wall from a compact nested position to an extended pouring position with a vent member closely overlying said spout in its retracted position. The spout has a sealing channel by which it is securely applied to a pail opening neck by means of a metal crimping ring. The overlying vent member has a peripheral lip by which it is mechanically secured in the spout sealing channel by the action of the crimping ring. The vent is formed to allow air entry at its periphery while permitting a central flow of liquid with the spout in extended pouring position. The resulting controlled fluid flow is thus achieved through the use of a simple self vent which closely conforms to the configuration of the nested spout and adds insignificantly to the nested vertical profile of the closure assembly. Moreover, the manner of mechanically securing the self vent to the container opening by means of the metal crimping ring further assures against damage to and separation of the vent under subsequent use conditions. The spout also has a hand removable sealing membrane sealing its opening as well as a reclosing cap for reclosing the opening when the seal is removed.

It is accordingly a principal object of the invention to provide a new and improved nestable pouring spout closure incorporating a self vent to facilitate smooth controlled pouring.

Another object is to provide a simple compact pouring vent for use in conjunction with nestable pouring spouts.

A further object is to provide an improved tamper evident nestable pouring spout capable of being readied for use completely with the unaided hand.

Other and more detailed objects will in part be obvious and in part be pointed out as the description taken in conjunction with the accompanying drawing proceeds.

In that drawing:

FIG. 3 is a sectional view of the pouring spout assembly crimped onto a container wall opening and in extended pouring position;

Figure 1:
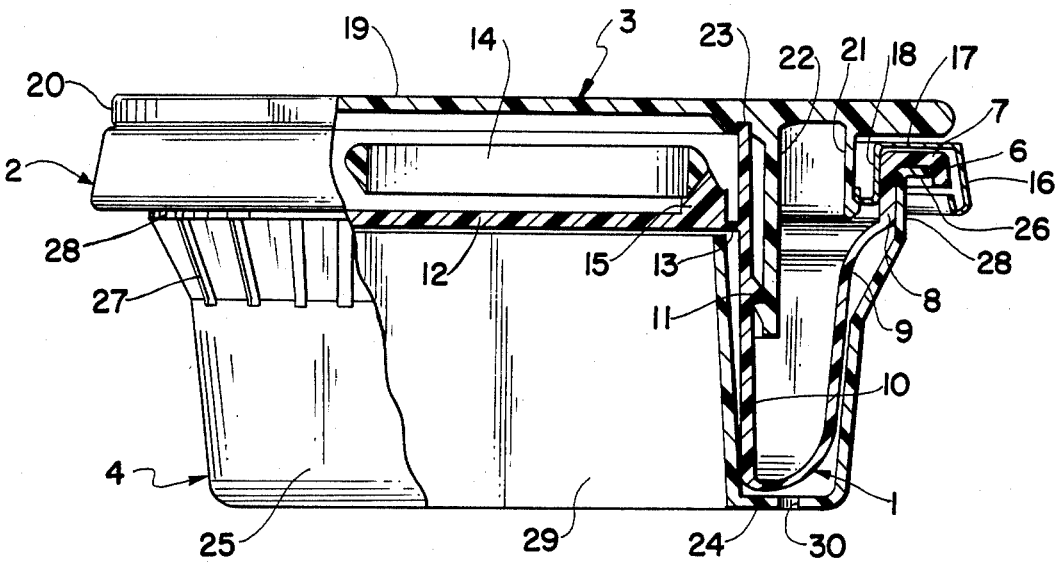
FIG. 1 is a part elevational part sectional view of the nestable pouring spout with pouring vent in accordance with the invention.
Figure 2:
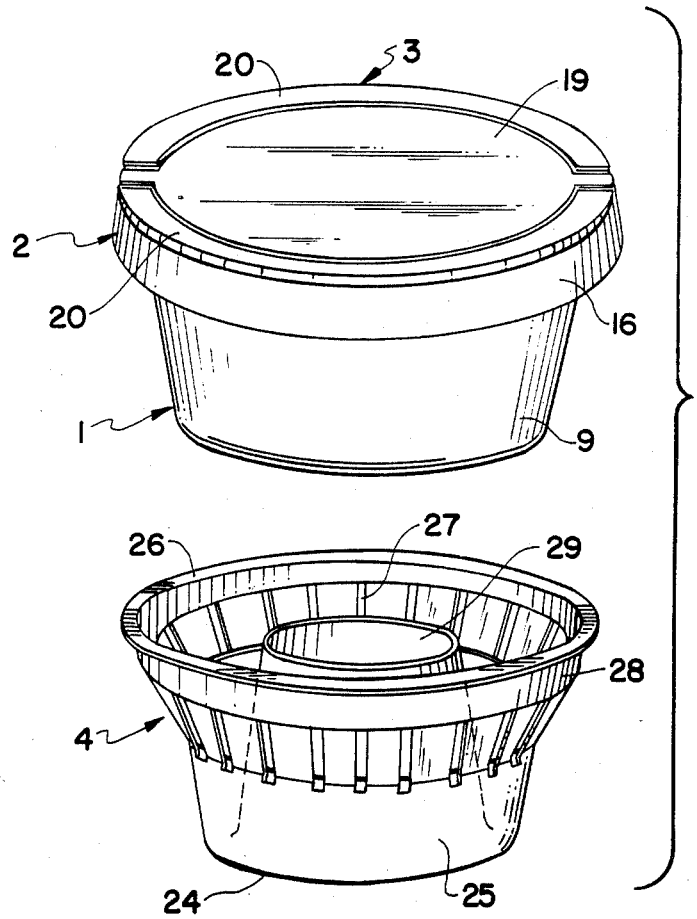
FIG. 2 is an exploded perspective view of the pouring spout closure and separately attached pouring vent.

FIG. 3*a* is an enlarged fragmentary sectional view of the spout container wall joint shown in FIG. 3; and FIG. 4 is a top plan view of the pouring vent.

In general terms, the self-vent pouring spout assembly in accordance with the invention consists of a nestable plastic pouring spout 1, a metal crimping ring 2, a plastic overcap 3 and a pouring vent 4.

More specifically the pouring spout 1 shown in stored or nested position has a peripheral inverted sealing channel at its base made up of a shortened outer wall 6 a top wall 7 and an elongated inner wall 8. A relatively flexible outer wall 9 extends from the lower end of the channel inner wall 8 to the lower end of a relatively rigid upstanding spout neck 10. The spout neck 10 has an exterior helical thread 11. Immediately above the thread, the spout neck 10 is closed off by a sealing membrane 12 surrounded by a tearing zone 13. A ring pull 14 suitable for grasping with the unaided finger closely overlies the membrane 12 in a horizontal plane and is integrally joined by a connecting neck 15 to the periphery of the membrane adjacent the tearing zone 13. The vertical clearance between the membrane and the ring pull is less than the vertical cross sectional thickness of the ring pull.

The metal crimping ring 2 has an inverted channel shaped configuration in cross section consisting of an elongated peripheral wall 16 terminating in an inwardly curled lower edge, a top wall 17 and a shortened inner wall 18 also terminating in a lowermost inward curl. The crimping ring 2 overlies and snugly confines the spout sealing channel therewithin.

The recloseable overcap 3 has a circumferentially enlarged top wall 19 surrounded by a pair of hinged lifting bails 20 which in their initial stored position overlie the metal ring 2. A cylindrical skirt 21 depends from the top periphery and interlockingly engages beneath the lower curled edge of the ring inner wall 18. An internally threaded cylindrical sidewall 22 also depends from the cap top for engagement with the external thread 11 on the spout neck 10. Full thread engagement and subsequent reclosing is achieved upon seating the uppermost end of the spout neck within the downwardly opening annular groove 23 disposed inside the sidewall 22. The spout, ring and cap are assembled as above described to give a secure compact closure unit adapted for efficient handling, shipment and storage.

A generally cup shaped pouring vent 4 may also be supplied as part of the assembly comprising an annular bottom wall 24 and an upstanding outer sidewall 25 terminating in a peripheral lip 26. A series of air entry slots 27 are formed in an annular zone near the upper end of the vent sidewall 25. The upper end of the sidewall 25 also includes a short cylindrical band 28 intermediate the lip 26 and slots 27. The center of the vent bottom wall 24 is open to provide a fluid exit passage surrounded by an upstanding inner wall 29. A small drainage aperture 30 is also provided in the bottom wall 24.

To adapt the closure assembly previously described to a self-vent unit the closure assembly is simply inserted into the vent 4 with the spout neck 10 and flexible wall 9 snugly confined within the annular pocket formed by the vent outer wall 25 and inner wall 29. Both inner and outer vent walls are tapered in their upward extent to aid assembly. As the vent and spout are compressed together the cylindrical band 28 at the upper end of the vent outer wall 25 tightly surrounds the spout sealing channel inner wall 8. When the vent lip 26 contacts the under surface of the sealing channel top wall 7 a secure friction fit engagement is created between vent band 28 and inner wall 8. Also upon completion of the assembly operation the uppermost end of the vent inner wall 29 surrounding the fluid exit passage lies just beneath the spout membrane 12. The complete self vent pouring spout assembly as seen in FIG. 1 thus becomes a secure, compact unit without resort to costly bonding assembly operations. Since the overall profile of the closure is changed very little, subsequent handling, packing and storage is economical and trouble free.

Turning to the application and use of the self-vent spout assembly it can be seen in FIG. 3 that when the spout sealing channel is placed on a container opening the vent lip 26 is tightly squeezed between the opening neck 31 and sealing channel top wall 7. The resulting mechanical interlock renders dislodgment of the vent virtually impossible. This arrangement proves highly desirable in counteracting the damaging forces normally created by the sloshing action of the contained fluid. Moreover, the heretofor deleterious swelling action imparted to synthetic plastic parts by normally packaged hydrocarbons becomes inconsequential.

To ready the closure for pouring the spout is raised by means of the large gripping bails 20 on the screw cap 3 causing the flexible wall 9 to unfold and reverse its disposition for erect pouring. Upon disengagement of the overcap 3 and tearing away of the membrane by means of the immediately accessible ring pull 14, the container is ready for dispensing. Liquid rapidly discharged through the central vent passage 29 is instantly displaced by atmospheric air traveling along the top inner surface of the spout and passing through the air entry slots 27. Having the membrane 12 disposed as near the spout opening as possible leaving just clearance for the ring pull 14 allows for maximum extension of the fluid passage wall 29. With the wall 29 reaching at least to the horizontal plane of the air entry apertures 27, sufficient separation of the outgoing fluid and the incoming air is achieved for satisfactory venting.

The self vent spout construction thus described facilitates rapid and accurate dispensing free of the uncontrolled pulsating surging characteristic of air locked containers. In addition to its simplicity and resultant cost effectiveness in manufacture, by maintaining substantially the same overall profile of the spout assembly when equipped with the self-vent, the conditions for packing and handling remain constant. This low profile construction is particularly advantageous in view of the common practice of stacking closure fitted lids.

Various other changes in or modifications of the pouring spout assembly and different embodiments of the invention would suggest themselves to those skilled in the art and could be made without departing from the spirit or scope of this invention. It is accordingly intended that all matter contained in the above description or shown in the accompanying drawing shall be interpreted as being illustrative and not in a limiting sense.

We claim:

1. An anti-surge pouring vent for nestable pouring spout closures comprising a thin walled plastic cup shaped member having an upstanding outer sidewall and a substantially imperforate annular bottom wall for substantially preventing the pouring of liquid therethrough, the upper portion of said sidewall having a series of circumferentially disposed air entry apertures, said sidewall upper portion terminating in closure engaging means and a central fluid exit passage formed within said annular bottom wall.

2. An anti-surge pouring vent as in claim 1 and said closure engaging means including a frictional engagement section on said sidewall.

3. An anti-surge pouring vent as in claim 1 and said closure engaging means including a circumferentially extending lip.

4. An anti-surge pouring vent as in claim 1 and said fluid passage including an upstanding tubular wall.

5. An anti-surge pouring vent as in claim 4 and said upstanding fluid exit passage extending upwardly at least to the horizontal plane of said air entry apertures.

6. In container closure construction a nestable integrally molded plastic pouring spout having an annular sealing channel peripherally disposed at one end, a relatively flexible outer wall extending downwardly from said sealing channel, a relatively rigid spout inner wall connected to the lowermost end of said spout outer wall and concentrically nested therewithin with said spout in stored position, said spout inner wall terminating in an uppermost free end, cap engaging means formed on said spout inner wall, a sealing membrane closing off said spout inner wall, an annular metal crimping ring overlying said spout sealing channel, an integrally molded plastic cap having a top wall and a depending skirt in engagement with said spout and an anti-surge pouring vent closely underlying and at least partially surrounding said pouring spout outer wall and substantially conforming to the contour of said outer wall in nested position so that the vertical profile of said nested spout is generally unchanged by the presence of said pouring vent.

7. In container closure construction as in claim 6 and said pouring vent including peripherally disposed air entry apertures and a centrally disposed liquid exit passage.

8. In container closure construction a container having an opening surrounded by an upstanding neck, a nestable integrally molded plastic pouring spout having an annular sealing channel peripherally disposed at one end and seated on said neck, a relatively flexible outer wall extending downwardly from said sealing channel, a relatively rigid spout inner wall connected to the lowermost end of said spout outer wall and concentrically nested therewithin with said spout in stored position, said spout inner wall terminating in an uppermost free end, cap engaging means formed on said spout inner wall, a sealing membrane closing off said spout inner wall, an annular metal crimping ring overlying said spout sealing channel, an integrally molded plastic cap in engagement with said spout and an anti-surge pouring vent underlying said pouring spout outer wall and said vent having a sidewall portion interposed said upstanding neck and sealing channel.

9. In container closure construction as in claim 8 and said pouring vent including air entry apertures closely adjacent said upstanding neck and a liquid exit passage axially displaced there below.

10. In container closure construction, a nestable integrally molded plastic pouring spout having an annular sealing channel peripherally disposed at one end, a relatively flexible outer wall extending downwardly from said sealing channel, a relatively rigid spout inner wall connected to the lowermost end of said spout outer wall and concentrically nested therewithin with said spout in stored position, said spout inner wall terminating in an uppermost free end, cap engaging means formed on said spout inner wall, a sealing membrane closing off said spout inner wall, an annular metal crimping ring overlying said spout sealing channel, an integrally molded plastic cap having a top wall and a depending skirt in engagement with said spout and an anti-surge pouring vent including peripherally disposed air entry apertures and a centrally disposed fluid exit passage, said vent at least partially closely circumferentially surrounding said pouring spout outer wall and generally conforming to the contour of said outer wall in nested position so that the vertical profile of said nested spout is generally unchanged by the presence of said pouring vent.

11. In container construction as in claim 10 wherein said pouring vent joins said pouring spout in close proximity to said spout sealing channel.

12. In container closure construction, a nestable integrally molded plastic pouring spout having an annular sealing channel peripherally disposed at one end, a relatively flexible outer wall extending downwardly from said sealing channel, a relatively rigid spout inner wall connected to the lowermost end of said spout outer wall and concentrically nested therewithin with said spout in stored position, said spout inner wall terminating in an uppermost free end, cap engaging means formed on said spout inner wall, a sealing membrane closing off said spout inner wall, an integrally molded plastic cap having a top wall and a depending skirt in engagement with said spout and an anti-surge pouring vent including peripherally disposed air entry apertures and a centrally disposed fluid exit passage, said vent depending from the periphery of said outer wall and at least partially closely circumferentially surrounding said pouring spout wall and generally conforming to the contour of said outer wall in nested position so that the vertical profile of said nested spout is generally unchanged by the presence of said pouring vent.

13. In container construction as in claim 12 wherein said air entry apertures are disposed in close proximity to said spout sealing channel.

14. In container closure construction, a nestable integrally molded plastic pouring spout having an annular sealing channel peripherally disposed at one end, a relatively flexible outer wall extending downwardly from said sealing channel, a relatively rigid spout inner wall connected to the lowermost end of said spout outer wall and concentrically nested therewithin with said spout in stored position, said spout inner wall terminating in an uppermost free end, cap engaging means formed on said spout inner wall, a sealing membrane closing off said spout inner wall, an integrally molded plastic cap having a top wall and a depending skirt in engagement with said spout and an anti-surge pouring vent adapted to facilitate smooth, surge-free pouring and including, with said spout in extended pouring position, peripherally disposed air entry apertures and a centrally disposed fluid exit passage, said vent depending from the periphery of said outer wall and at least partially circumferentially surrounding said pouring spout outer wall and generally conforming to the contour of said outer wall in nested position so that the vertical profile of said nested spout is generally unchanged by the presence of said pouring vent.

* * * * *